United States Patent [19]

Fukuda

[11] 4,090,658

[45] May 23, 1978

[54] EGG CONTAINER

[75] Inventor: Minolu Fukuda, Funabashi, Japan

[73] Assignee: Norihiko Takahashi, Hakodate, Japan

[21] Appl. No.: 727,131

[22] Filed: Sep. 27, 1976

Related U.S. Application Data

[63] Continuation of Ser. No. 567,848, Apr. 14, 1975, abandoned.

[51] Int. Cl.[2] ..... B56D 1/24

[52] U.S. Cl. ..... 229/2.5 EC; 217/26.5; 229/45 EC

[58] Field of Search ..... 229/2.5 EC, 44 EC, 45 EC, 229/29 M; 217/25.5, 26, 26.5, 28

[56] References Cited

U.S. PATENT DOCUMENTS

| | | | |
|---|---|---|---|
| 755,640 | 3/1904 | Drake | 217/26.5 |
| 1,967,040 | 7/1934 | Pickett | 217/26.5 |
| 2,752,084 | 6/1956 | Shepard | 229/2.5 EC |
| 3,234,030 | 2/1966 | Knirim | 229/2.5 EC X |
| 3,356,277 | 12/1967 | Hohnjel | 229/44 EC X |

FOREIGN PATENT DOCUMENTS

| | | | |
|---|---|---|---|
| 710,662 | 8/1931 | France | 217/26.5 |
| 718,122 | 10/1966 | Italy | 229/2.5 EC |
| 824,079 | 11/1959 | United Kingdom | 229/2.5 EC |

*Primary Examiner*—Stephen Marcus
*Attorney, Agent, or Firm*—Haight & Huard

[57] ABSTRACT

An egg packing container having in rows a number of egg-receiving hollows in a receptacle and its lid. A ventilating groove is provided in each row of the egg-receiving hollows or recesses of the receptacle and lid, the ventilating groove extending from one end to the other end of the container through bottom portions of the egg-receiving recesses to allow fresh air to enter the container, particularly the bottom portions of the respective egg-holding recesses. A closing flap is flexibly connected to the receptacle for holding the lid in the closed position without using additional fixing means.

6 Claims, 4 Drawing Figures

EGG CONTAINER

This is a continuation of application Ser. No. 567,848, filed Apr. 14, 1975 now abandoned.

BACKGROUND OF THE INVENTION

This invention relates to egg packing containers having in rows a number of round hollows or recesses in a receptacle and a flap lid for accommodating eggs individually therein.

In packing eggs, it is well known in the art to employ a container which has a number of round hollows or recesses formed in rows in a receptacle of a generally rectangular shape and also in a lid or cover of a similar shape which has one longitudinal side edge flexibly or hingedly connected to one longitudinal side edge of the receptacle, so that the lower and upper portions of the eggs are accommodated respectively in the round hollows of the receptacle and lid when the latter is closed on the former. After packing eggs, the other free longitudinal side edge of the lid is usually fixed to the mating side edge of the receptacle by means of adhesive tape strips or staple pins. When opening such an egg container, difficulty is often encountered in removing the adhesive tapes or staple pins, and the container is liable to be broken or deformed to a degree as would prohibit reuse of the container.

SUMMARY OF THE INVENTION

It is therefore an object of the present invention to provide an egg container which is simple in construction and has means for releasably securing the lid in the closed position without resorting to additional fixing means such as adhesive tapes and staple pins.

It is another object of the present invention to provide an egg container which can be opened and closed in a facilitated manner.

It is a further object of the invention to provide an egg container which can maintain eggs in a fresh state for a longer period of time as compared with the conventional counterparts.

It is a still further object of the invention to provide an egg container which has minimal susceptibility to damage upon opening same to allow repeated use.

It is a further object of the invention to provide an egg container which can hold eggs securely and with sufficient stability.

In a preferred form of the invention, the egg container comprises: a receptacle generally of a rectangular shape and having in rows a number of egg-receiving round recesses; a lid of a shape similar to said receptacle and having one longitudinal side edge flexibly and integrally connected to one longitudinal side edge of said receptacle, said lid having in rows a number of egg-receiving round recesses corresponding to said egg-receiving recesses of said receptacle; a closing flap flexibly and integrally connected to the other longitudinal side edge of said receptacle and having a row of extra recesses of a shape similar to said egg-receiving recesses of said lid; and ventilating grooves extending longitudinally from one end to the other end of said container through bottom portions of said egg-receiving recesses of said receptacle and lid.

The above and other objects, features and advantages of the invention will become clear from the following description and the appended claims, taken in conjunction with the accompanying drawings which show by way of example a preferred embodiment of the invention.

PARTICULAR DESCRIPTION OF THE INVENTION

Figure 1:
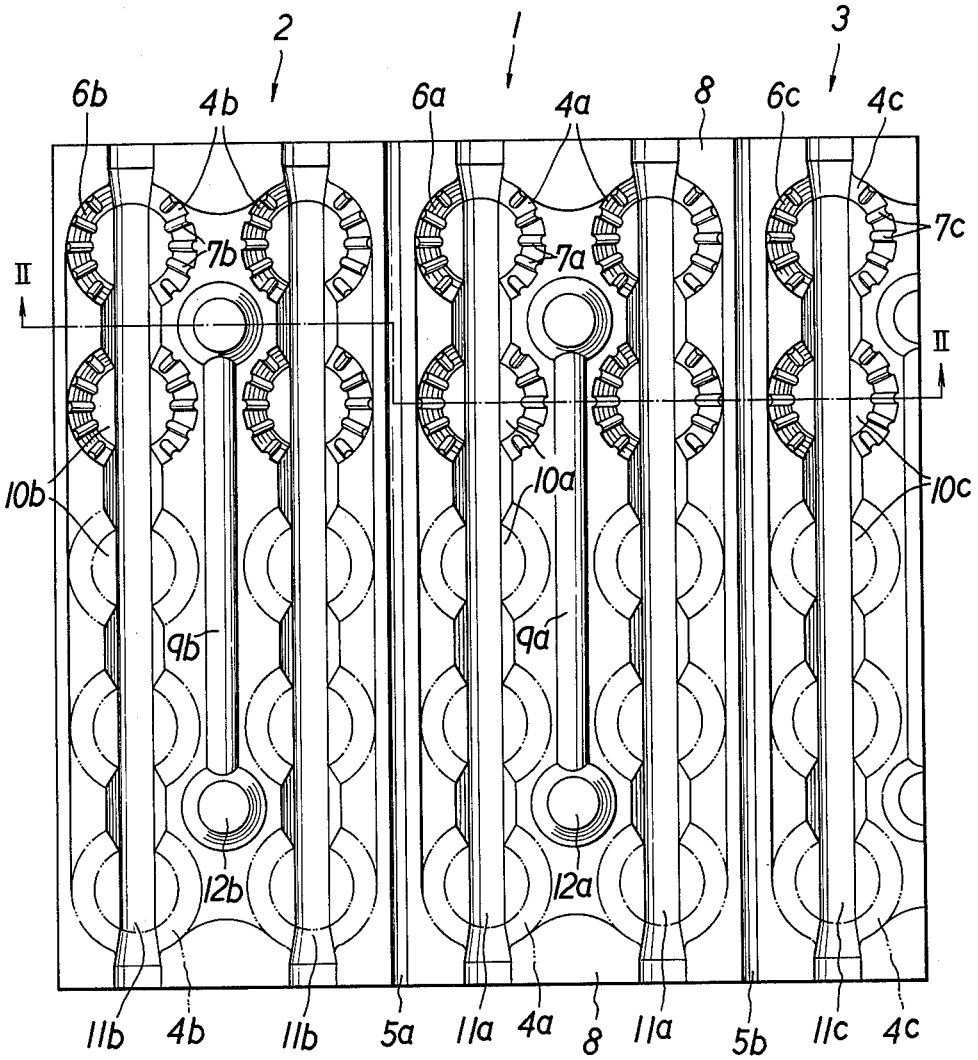
FIG. 1 is a diagrammatic plan view showing the egg container of the invention in an extended state.
Figure 2:
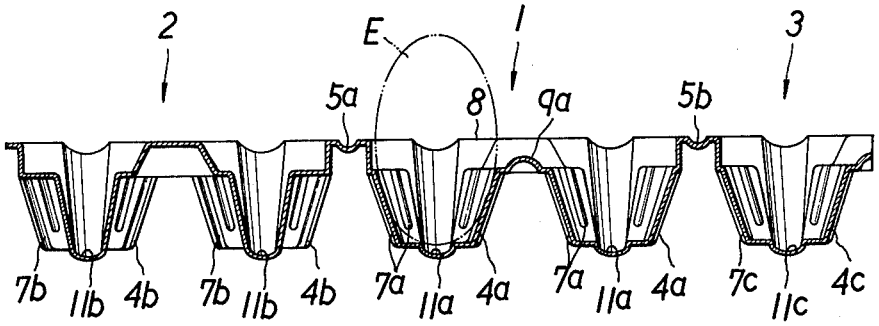
FIG. 2 is a diagrammatic sectional view taken on line II — II of FIG. 1.
Figure 3:
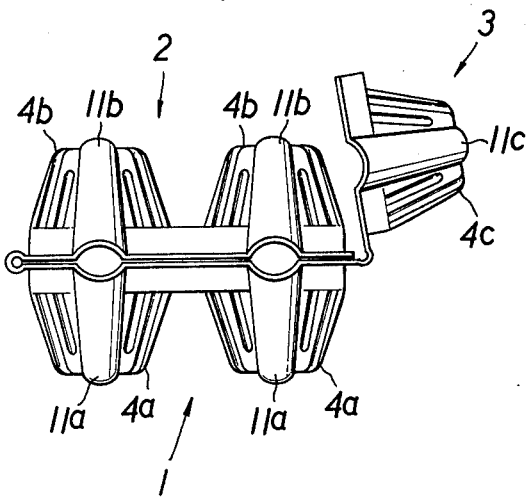
FIG. 3 is a diagrammatic front view of the egg container as in use.

The invention will now be described more particularly with reference to the preferred embodiment shown in the accompanying drawings. Referring first to FIG. 1, the egg packing container according to the invention includes a receptacle 1 of a generally rectangular shape and having in two rows a number of round hollows or recesses 4*a* each for receiving lower portions of an egg E. One longitudinal side edge of the receptacle 1 is flexibly or hingedly connected through a connecting portion 5*a* to one longitudinal side edge of a lid or cover 2 which has a shape similar to the receptacle 1 and likewise has in two rows a number of round recesses or hollows 4*b* each for receiving upper portions of an egg. The round recesses 4*a* and 4*b* of the receptacle 1 and lid 2 are formed in symmetrical positions relative to the connecting portion 5*a* so that, when the lid 2 is closed on the receptacle 1, they will meet corresponding recesses in the receptacle 1 or the lid 2 for snugly holding eggs therein respectively. The other longitudinal side edge of the receptacle 1 is connected through a flexible connecting portion 5*b* to a closing flap 3 which has a row of similar round recesses 4*c*. These round recesses 4*c* in the closing flap 3 are fit over the outer row of the round recesses 4*b* of the lid 2 when the container is closed as shown in FIG. 3. The above-mentioned receptacle 1, lid 2 and connecting portions 5*a* and 5*b* are preferably formed integrally with each other by a known process using a suitable synthetic resin material.

The receptacle 1 and lid 2 have a number of reliefs or ribs 7*a* and 7*b* on the inner surfaces of the circumferencial walls of the recesses 4*a* and 4*b*, the ribs extending along the inner surface convergingly toward the bottom of each recess. The round recesses 4*a* or 4*b* of each row are separated from the recesses in the next row by means of a longitudinal partition wall 9*a* or 9*b* which is formed slightly short of the peripheral meeting edge 9*a* or 9*b* of the receptacle 1 or lid 2 and are in communication with each other through a substantially planar longitudinal groove 11*a* (11*b*) which extends from one end to the other of the container through the bottom portions of the recesses 4*a* (4*b*).

In this connection, with a conventional egg container, each egg-receiving recess is separated independently from others by its own peripheral wall and the egg is accommodated in close contact with the peripheral wall of the recess for the purpose of holding the egg with sufficient stability. However, this usually results in inferior ventilation, particularly at the opposite ends of the egg which are received in the closed bottom portions of the recesses, obstructing respiration of the living egg. Thus, the egg tends to decompose easily and in an accelerated manner, particularly under hot and high humidity weather conditions as in summer, due to the moisture trapped in the bottom portions of the recesses.

The egg container of the invention is exempt from the just-mentioned difficulty as the longitudinal partition walls which divide the adjacent rows of the egg-receiving recesses are formed short of the meeting edges of the receptacle and lid and a longitudinal ventilating groove is provided in each row to extend through the bottom portions of the respective recesses, thus allowing fresh air to enter the container and into the bottom portions of the egg-accommodating recesses.

As described hereinbefore, a closing flap 3 which has a row of recesses 4*c* similar to those (4*b*) in the lid 2 is connected flexibly at the longitudinal side edge of the receptacle 1 remote from the lid 1, so that, when the lid 2 is closed on the receptacle 1, the closing flap 3 may be securely but releasably fit in its entire area over the domed walls of the egg-receiving recesses 4*b* of the lid 2. Due to its resiliency and flexibility, the closing flap 3 may be tightly and securely fit over the domed circumferencial walls of the recesses 4*b* and may be removed therefrom without difficulty.

If desired, a suitable number of projections 12*a* and 12*b* may be provided on the longitudinal partition walls 9*a* and 9*b* of the receptacle 1 and lid 2 for abutting engagement with each other when the container is closed. Such projections will contribute to increase the rigidity in the middle portions of the container.

Figure 4:
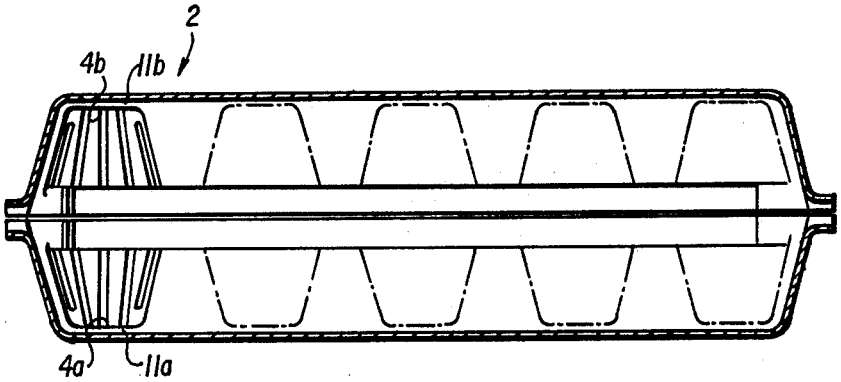
FIG. 4 is a diagrammatic side view of the egg container.

As can best be seen in FIG. 4, longitudinal ventilation groove 11*b* in the lid 2 extends continuously from one end of the lid to the other and thereof below the egg-receiving portion of the recesses; since the securing flap 3 engages the lid ventilation groove, the corresponding longitudinal ventilation groove 11*c* shown in FIG. 1 will be similarly shaped.

The recesses 4*c* which are formed in a row in the closing flap 3 are provided with ribs 7*c* which are similar to those (7*b*) on the inner surfaces 4*b* of the lid 2. The ribs 7*c* are projected inwardly from the inner surfaces of the peripheral walls 6*c* which surround the recesses 4*c*, so that they may come into intimate engagement with the grooves on the back side of the ribs 7*b* on the circumferential walls of the recesses 4*b* of the lid 2. The closing flap also has a substanially planar longitudinal groove 11*c* which extends from one end to the other of the container through bottom portions of the respective recesses 4*c*. With this construction, the flap 3 is flexed at the longitudinal groove 11*c* when pulled for opening the container, thus facilitating the opening all the more.

In packing, the eggs are placed in the recesses 4*a* of the receptacle 1 and the lid 2 is closed on the receptacle 1 as shown in FIG. 3. The lid 2 can be fixed in the closed position simply by fitting the recesses 4*c* of the closing flap 3 over the circumferencial walls of the recesses 4*b* of the lid 2.

It will be understood from the foregoing description that, the eggs can be maintained in a fresh state for a longer period of time by the fresh air taken through the longitudinal groove which extends from one end to the other of the container through the bottom portions of the egg-receiving recesses of each row in the receptacle 1 and lid 2. Moreover, as mentioned hereinbefore, by the provision of a longitudinal groove 11*c* is also provided in the closing flap 3 through the bottom portions of the recesses 4*c* which are aligned in one row, so that the flap 3 is flexed at the longitudinal groove 11*c* when the free edge of the flap 3 is pulled for opening the container, ensuring the container to be opened easily and smoothly. The flexibility and resiliency of the closing flap 3 can also contribute to facilitate the closing operation and to grip the circumferencial walls of the recesses 4*b* of the lid 2 securely and intimately by the entire area of the closing flap 3. As the egg container of the invention can be closed very easily without resorting to adhesive tape or staple pins, the packing operation can be carried out automatically on a machine. Furthermore, as the containers have minimal liability of undergoing any material breakage or deformation as would be caused when removing adhesive tape or staple pins, they can be collected for reuse, if desired.

What is claimed is:

1. An egg container comprising:

(a) a generally rectangular receptacle having two parallel rows of egg-receiving round recesses therein, the bottom portions of each recess in each row communicating with a longitudinal ventilation groove extending from one end of the receptacle to the other end thereof below the egg-receiving portion of said recesses;

(b) a corresponding generally rectangular lid having one longitudinal side edge flexibly connected along a longitudinal hinging groove to a first longitudinal side edge of said receptacle, said lid having two parallel rows of egg-receiving round recesses therein, the bottom portions of each recess in each row communicating with a single, longitudinal ventilation groove formed within the bottom of said lid and continuously extending from one end of the lid to the other end thereof below the egg-receiving portion of said recesses; and (c) a securing flap formed of a synthetic resin material and having a longitudinal edge flexibly connected to a second longitudinal side edge of said receptacle along a longitudinal hinging groove, said securing flap having a single row of round recesses adapted to tightly and resiliently engage the outer surfaces of the row of egg-receiving recesses in said lid which is adjacent said securing flap when said lid is in the closed position, said securing flap further including a single, longitudinal flexible groove formed within the bottom of said flap and extending continuously from one end of the securing flap to the other end thereof so as to be in communication with the bottom portions of said recesses in said securing flap for resiliently flexing when engaging or disengaging said ventilation groove of said lid and when said recesses of said flap engage or disengage said corresponding recesses of said lid.

2. An egg container as set forth in claim 1 wherein the flexible groove of said securing flap is adapted to overlap the outer surface of the ventilation groove associated with the recesses in said lid which the recesses in said securing flap engage.

3. An egg container as set forth in claim 2, wherein adjacent rows of said egg-receiving recesses in said receptacle and said lid are separated from each other by partition walls which are formed short of peripheral meeting edges of said receptacle and lid.

4. An egg container as set forth in claim 3, wherein said partition walls of said receptacle and lid are provided with projections which are held in abutting engagement with each other when said container is in closed position.

5. An egg container as set forth in claim 2, wherein each one of said egg-receiving recesses of said receptacle and lid has on an inner surface of the peripheral wall thereof a number of ribs extending convergingly toward the bottom of said recess.

6. An egg container as set forth in claim 2, wherein each recess in said closing flap has a number of ribs extending convergingly toward the bottom of each recess.

* * * * *